US005675907A

United States Patent [19]

Reppas et al.

[11] Patent Number: 5,675,907

[45] Date of Patent: Oct. 14, 1997

[54] COLLAPSIBLE FOOT DRYER

[76] Inventors: George S. Reppas, 1030 San Raymundo Rd., Hillsborough, Calif. 94010; Robert G. Reppas, Chapfstrasse 49 CH-8126, Zumikon, Switzerland; Charles B. Reppas, 502-225 Place South East, Bothell, Wash. 98021; Katherine R. Morse, 830 Edinburgh St., San Mateo, Calif. 94402

[21] Appl. No.: 621,082

[22] Filed: Mar. 22, 1996

[51] Int. Cl.[6] ..... F26B 19/00

[52] U.S. Cl. ..... 34/202; 34/91

[58] Field of Search ..... 34/90, 91, 202

[56] References Cited

U.S. PATENT DOCUMENTS

| | | | |
|---|---|---|---|
| 1,413,862 | 4/1922 | MacDonald . | |
| 1,658,489 | 2/1928 | Lindstrom . | |
| 2,247,483 | 7/1941 | Eastman . | |
| 2,260,587 | 10/1941 | Lasha | 34/202 |
| 2,779,856 | 1/1957 | Fahner . | |
| 2,953,805 | 9/1960 | Sevenich . | |
| 3,089,942 | 5/1963 | Wrigglesworth et al. . | |
| 3,378,009 | 4/1968 | Peplin . | |
| 3,683,896 | 8/1972 | Peplin . | |
| 3,711,958 | 1/1973 | Lepage . | |
| 3,986,643 | 10/1976 | Chutter . | |
| 4,492,221 | 1/1985 | Kerley . | |
| 4,782,601 | 11/1988 | Gonzalez . | |
| 4,878,602 | 11/1989 | Weigelt . | |
| 5,003,705 | 4/1991 | Lee . | |
| 5,007,182 | 4/1991 | Fishman et al. . | |
| 5,014,446 | 5/1991 | Reesman | 34/202 |
| 5,130,551 | 7/1992 | Nafziger et al. . | |
| 5,157,850 | 10/1992 | Terng-Shuh . | |
| 5,438,764 | 8/1995 | Reppas et al. . | |
| 5,454,060 | 9/1995 | McDermott . | |

FOREIGN PATENT DOCUMENTS

| | | |
|---|---|---|
| 9001372 A | 10/1991 | Brazil . |
| 0 481 925 A1 | 4/1992 | European Pat. Off. . |
| 2 216 529 | 8/1974 | France . |
| 3610560 A1 | 10/1987 | Germany . |
| 670 368 A5 | 6/1989 | Switzerland . |
| 345896 | 4/1931 | United Kingdom . |

*Primary Examiner*—Henry Bennett
*Assistant Examiner*—D. Doster
*Attorney, Agent, or Firm*—Harness, Dickey & Pierce, P.L.C.

[57] ABSTRACT

A foot dryer designed to dry the toes and areas between the toes on an individual's foot includes a housing which is designed to accept and support a conventional hair dryer. The housing is a box-like structure which defines an internal cavity. A cradle is located within the cavity and the cradle is designed to accept a number of the conventional hair dryers available on the market. The cradle supports the hair drying in a position where the air flow from the hair dryer is directed through a plurality of apertures in the top panel of the housing. An aperture in one of the side panels of the housing allows for the insertion and removal of the hair dryer into engagement and disengagement with the cradle.

13 Claims, 3 Drawing Sheets

COLLAPSIBLE FOOT DRYER

CROSS REFERENCE TO RELATED APPLICATIONS

This application is related to U.S. patent application Ser. No. 08/516,003, filed Aug. 16, 1995, now abandoned which is related to U.S. patent application Ser. No. 08/186,651, filed Jan. 25, 1994, which is now U.S. Pat. No. 5,438,764.

FIELD OF THE INVENTION

The present invention relates to a portable dryer. More particularly, the present invention relates to a portable foot dryer which uses a standard hair dryer positioned within a collapsible housing for drying an individual's feet.

BACKGROUND OF THE INVENTION

*Tinea pedis* (fungus of the foot), what is commonly called athlete's foot, is a reoccurring problem among numerous individuals. Athlete's foot is highly contagious and is easily transmitted between individuals via personal items such as clothes, towels and sports equipment which are used by more than one individual. In addition, athletes foot can be easily caught by simply walking barefoot in public showers, baths or damp places. Fungus, in general, thrive in a warm, dark and damp environment. An individual's foot, especially the area between the toes, creates a perfect environment for the spread of fungus. An individual's foot has extensive sweat glands which dampen the shoes and socks of the individual, creating the perfect environment for the growth or spread of fungus.

In order to prevent and/or cure athlete's foot, numerous products are available. These include sprays, powders, ointments and other types of treatments. One of the most effective preventative methods and/or treatments for athlete's foot is to insure that the foot in general and the area between the toes in particular is kept dry in order to prevent the growth and spread of the fungus. When the dryness of the foot is combined with the application of an antiseptic treatment such as foot powder, effective prevention and/or treatment of athlete's foot is further achieved.

SUMMARY OF THE INVENTION

The present invention provides the art with a unique foot drying apparatus comprised of a standard hair dryer adapted to cooperate with a collapsible housing for effectively drying the area of the foot located between the toes. The foot drying apparatus can include a bar that functions as a toe rest to facilitate the raising and separating of the toes during drying.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
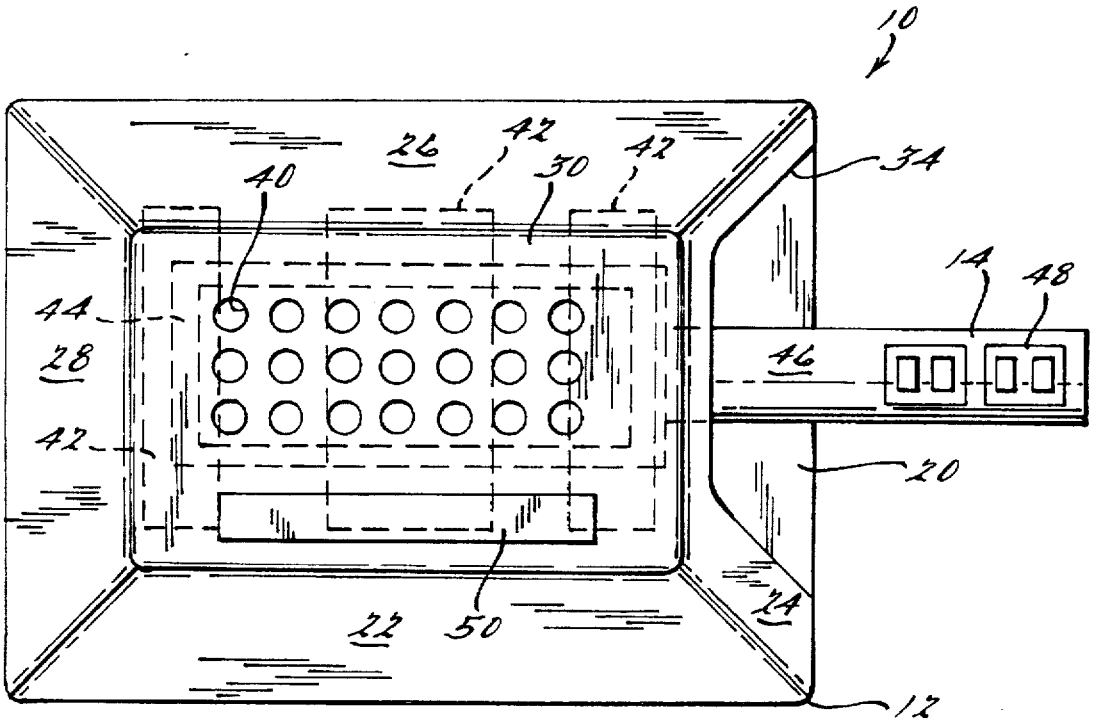
FIG. 1 illustrates a top plan view of the foot dryer according to the present invention.
Figure 2:
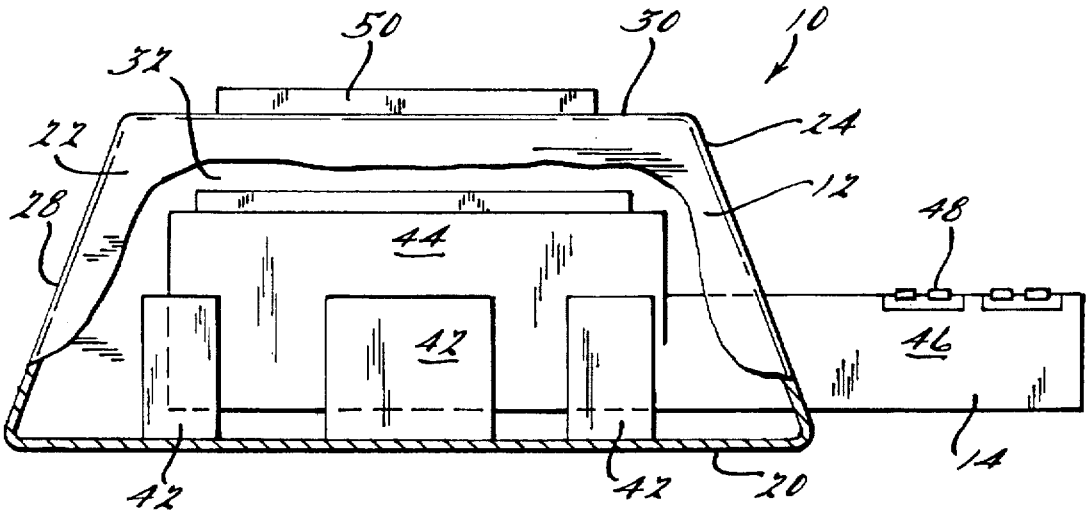
FIG. 2 illustrates a front elevational view of the foot dryer shown in FIG. 1 with a portion of the front housing panel removed.

Referring now to the drawings in which like reference numerals designate like or corresponding parts throughout the several views, there is shown in FIGS. 1 and 2, a foot drying apparatus in accordance with the present invention which is designated generally by the reference numeral 10. Foot drying apparatus 10 comprises a housing 12, and a removable portable hair dryer 14.

Housing 12 is a generally trapezoidal shaped box having a bottom panel 20, four side panels 22, 24, 26 and 28 and a top panel 30 which define an internal cavity 32. Bottom panel 20 provides support for hair dryer 14 of apparatus 10 and acts as a base for supporting the weight of the individual using the apparatus. Side panels 22, 24, 26 and 28 extend angularly upward from bottom panel 20 to provide support for top panel 30 and form the generally trapezoidal shape of housing 12. Although housing 12 is illustrated for exemplary purposes as being generally trapezoidal in shape, it is to be understood that other shapes can be used for housing 12.

Top panel 30 defines a plurality of apertures 40 extending through it for providing air blown by hair dryer 14 to exit housing 12 and be directed against the individual's foot. Bottom panel 20 supports a cradle 42 which is shaped to accept and hold in position hair dryer 14 within cavity 32. Side panel 24 defines an aperture 34 which provides for the selective insertion and removal of hair dryer 14 into and out of cradle 42 and cavity 32.

Hair dryer 14 is a conventional hair dryer which rests in cradle 42 to direct blown air through the plurality of apertures 40 to dry an individual's foot. Hair dryer 14 includes a body portion 44 and a handle 46. As is known in the art and common to portable hair dryers, a plurality of switches 48 are placed on handle 46 or otherwise located on hair dryer 14 to control the actuation of hair dryer 14 and both the volume and temperature of the airflow therefrom.

Hair dryer 14 is seated within cavity 32 in cradle 42 such that the outflow of air from body portion 44 is directed through the plurality of apertures 40. Cradle 42 is a universal design which can accommodate a number of the conventional hair dryers available on the market today. Once dryer 14 has been positioned within cradle 42, cradle 42 provides for the flail support of dryer 14 and means for retaining dryer 14 other than cradle 42 are not required.

Top panel 30 of housing 12 may also be provided with a foot rest member such as a bar 50 which functions as a toe raiser and spreader.

The operation of foot drying apparatus 10 begins with an individual inserting hair dryer 14 through aperture 34 and into cavity 32. Either before or after the insertion of hair dryer 14 switches 48 need to be actuated in order to have hair dryer 14 blow the desired temperature of air through apertures 40. Hair dryer 14 is positioned within cradle 42 in order to direct the air flow through apertures 40. The individual then places the ball of their foot on top cover 30, or on bar 50 if provided, to position their toes over apertures 40 and into the stream of blown air from hair dryer 14. The act of placing the individual's weight or the ball of the foot operates to spread the toes of the individual. This also allows the individual to flex their toes in an upward direction which then has a further tendency to spread their toes and open the area between their toes to the air being blown by hair dryer 14.

When the drying operation is complete, the individual removes his foot from foot drying apparatus 10, removes hair dryer 14 from cradle 42 and cavity 32 through aperture 34 and deactivates hair dryer 14 using switches 48.

Figure 3:
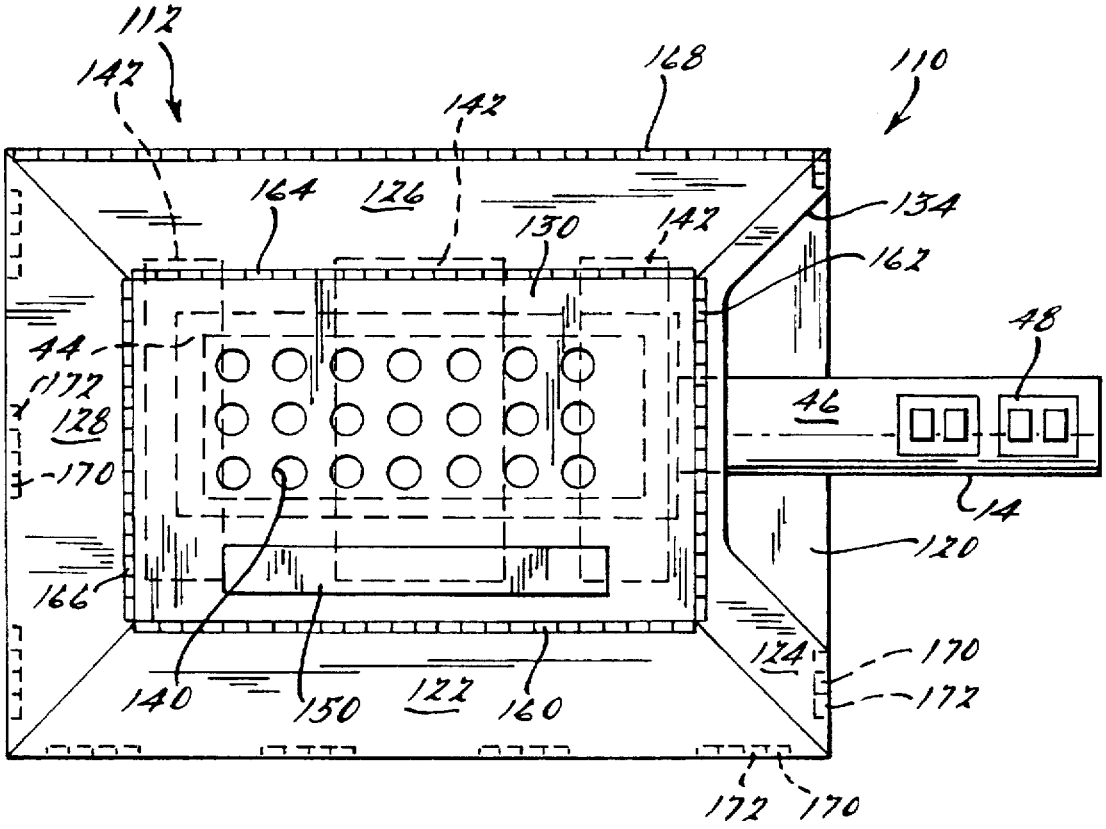
FIG. 3 illustrates a top plan view of the foot dryer according to another embodiment of the present invention.
Figure 4:
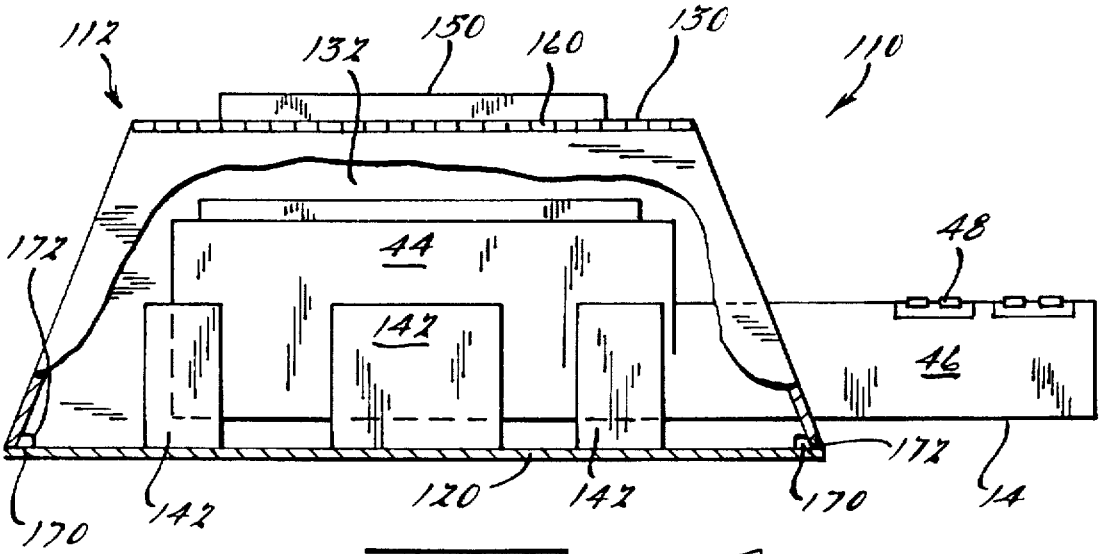
FIG. 4 illustrates a front elevational view of the foot dryer shown in FIG. 3 with a portion of the front housing panel removed.
Figure 5:
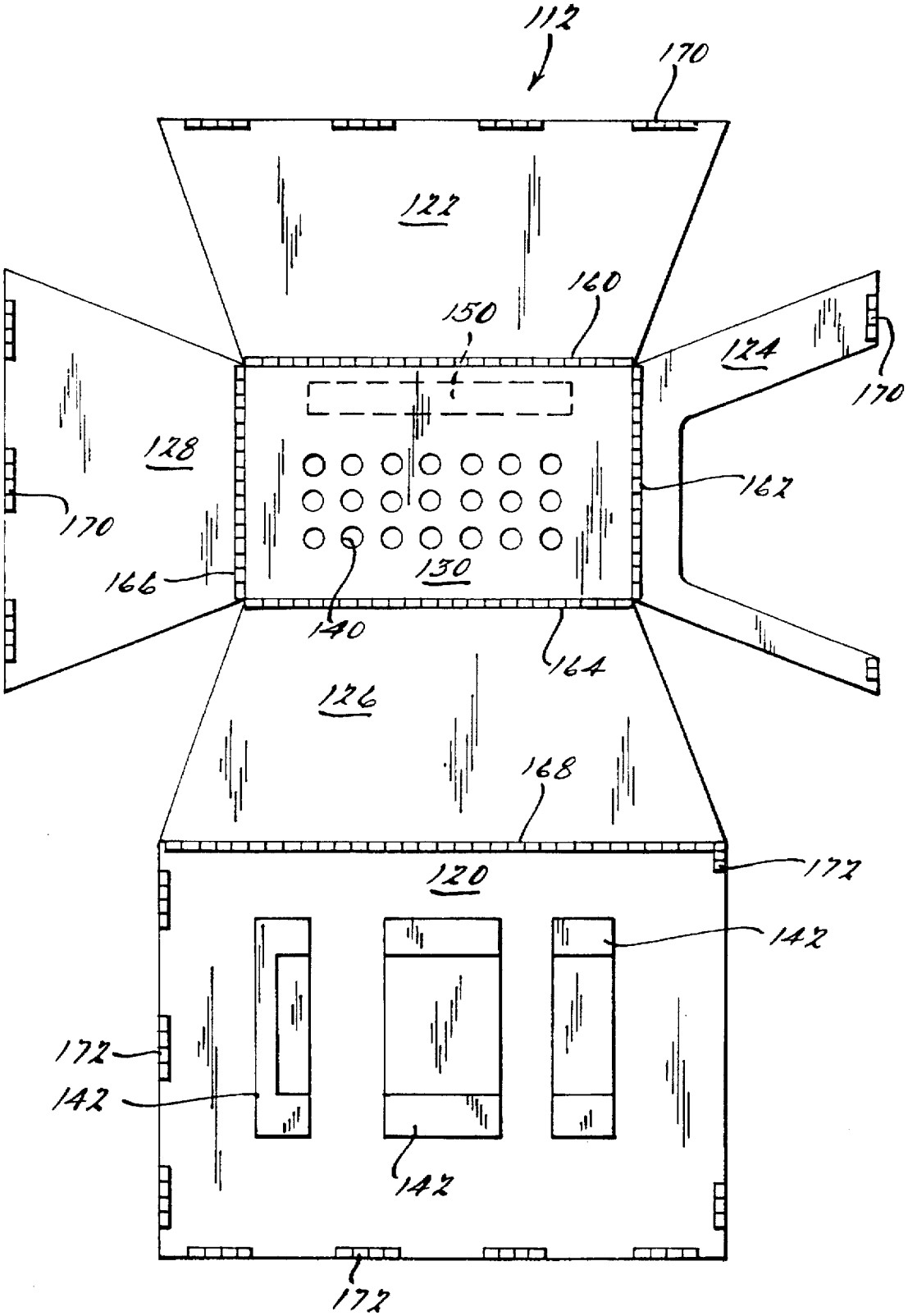
FIG. 5 illustrates a schematic plan view of the housing shown in FIGS. 3 and 4 in a disassembled condition.

An additional embodiment of the present invention is shown in FIGS. 3 through 5. Foot drying apparatus 110 shown in FIGS. 3 through 5 comprises a housing 112 and removable portable hair dryer 14. Housing 112 is similar to housing 12 with the exception that housing 112 is collapsible in order to facilitate the packing of housing 112 into a suitcase or the like when it is desired to take the foot drying apparatus 110 along with an individual during vacation, business or other travel.

Housing 112 is a generally trapezoidal shaped box when it is erected as shown in FIGS. 3 and 4, having a bottom panel 120, four side panels 122, 124, 126 and 128 and a top panel 130 which define an internal cavity 132. FIG. 5 illustrates housing 112 in a non-erected, non-folded condition to illustrate the interface between bottom panel 120, side panels 122, 124 and 126 and 128 and top panel 130. Each side panel 122, 124, 126 and 128 are secured to top panel 130 by a hinge 160, 162, 164 and 166, respectively. Bottom panel 120 is secured to side panel 122 by a hinge 168. Side panel 122, 124 and 128 each include a plurality of retainers 170 located on the edges of side panels 122, 124 and 128 opposite to hinges 160, 162 and 166, respectively. Retainers 170 are designed to releasably engage a plurality of corresponding retainers 172 located on the three outside edges of base 120, as shown in FIG. 3. Retainers 170 releasably engage retainers 172 in order to permit the fabrication of housing 112 and provide for the strength of housing 112 to support the weight of an individual's foot during the drying process.

Once fabricated, bottom panel 120 provides support for hair dryer 14 of apparatus 110 and acts as a base for supporting the weight of the individual using the apparatus. Side panels 122, 124, 126 and 128 extend angularly upward from bottom panel 120 to provide support for top panel 130 and form the generally trapezoidal shape of housing 112. Although housing 112 is illustrated for exemplary purposes as being generally trapezoidal in shape, it is to be understood that other shapes can be used for housing 112.

Top panel 130 defines a plurality of apertures 140 extending through it for providing air blown by hair dryer 14 to exit housing 112 and be directed against the individual's foot. Bottom panel 120 supports a cradle 142 which is shaped to accept and hold in position hair dryer 14 within cavity 132. Side panel 124 defines an aperture 134 which provides for the selective insertion and removal of hair dryer 14 into and out of cradle 142 and cavity 132.

Hair dryer 14 is seated within cavity 132 in cradle 142 such that the outflow of air from body portion 44 is directed through the plurality of apertures 140. Cradle 142 is similar to cradle 42 in that it is a universal design which can accommodate a number of the conventional hair dryers on the market today. Once dryer 14 has been positioned within a cradle 142, cradle 142 provides for the full support of hair dryer 14 and means for retaining dryer 14 other than cradle 142 are not required.

Top panel 130 of housing 112 may also be provided with a foot rest member such as a bar 150 which functions as a toe raiser and spreader.

The operation of foot drying apparatus 110 is the same as the operation of foot drying apparatus 10 once housing 112 has been fabricated as shown in FIGS. 3 and 4. Hair dryer 14 is turned on using switches 48 and inserted into cavity 132 and cradle 142 through aperture 134. Once the drying operation is complete, hair dryer 14 is removed from cradle 142 and cavity 132 through cavity 134 and subsequently turned off using switches 48.

While this detailed description describes several embodiments of the present invention, it should be understood that the present invention is susceptible to modification, variation and alteration without deviating from the scope and fair meaning of the subjoined claims. Various other advantages and modifications will become apparent to one skilled in the art after having the benefit of studying the teachings of the specification, the drawings and the following claims.

What is claimed is:

1. A collapsible apparatus for drying toes on a foot of an individual using a hair dryer, said apparatus comprising:

a bottom panel;

a plurality of side panels extending upwardly from said bottom panel;

a top panel supported by said side panels, said top panel defining a plurality of apertures, said bottom panel, said side panels and said top panel defining a collapsible housing having a cavity; and a cradle disposed within said cavity for releasably supporting said hair dryer in such a position that air blown from said hair dryer is directed through said plurality of apertures in said top panel.

2. The apparatus according to claim 1 wherein one of said plurality of side panels defines a side aperture, said hair dryer being insertable through said side aperture for engagement with said cradle.

3. The apparatus according to claim 1 wherein said cradle is supported by said bottom panel.

4. The apparatus according to claim 1 wherein said top panel defines a foot rest.

5. The apparatus according to claim 1 further comprising a hinge for attaching one of said side panels to said top panel.

6. The apparatus according to claim 1 further comprising a hinge for attaching one of said side panels to said bottom panel.

7. An apparatus for drying toes on a foot of an individual using a hair dryer, said apparatus comprising:

a bottom panel;

a plurality of side panels extending upward from said bottom panel;

a top panel supported by said side panels, said top panel defining a plurality of apertures, said bottom panel, said side panels and said top panel defining a collapsible housing having a cavity;

a cradle disposed within said cavity for releasably supporting said hair dryer in such a position that air blown from said hair dryer is aligned with said plurality of apertures in said top panel to direct said air directly through said plurality of apertures in said top panel.

8. The apparatus according to claim 7 wherein one of said plurality of side panels defines a side aperture, said hair dryer being insertable through said side aperture for engagement with said cradle.

9. The apparatus according to claim 7 wherein said cradle is supported by said bottom panel.

10. The apparatus accoridng to claim 7 wherein said apparatus is collapsible.

11. The apparatus according to claim 7 wherein said top panel defines a foot rest.

12. The apparatus according to claim 7 further comprising a hinge for attaching one of said side panels to said top panel.

13. The apparatus according to claim 7 further comprising a hinge for attaching one of said side panels to said bottom panel.

* * * * *

UNITED STATES PATENT AND TRADEMARK OFFICE

CERTIFICATE OF CORRECTION

PATENT NO. : 5,675,907
DATED : October 14, 1997
INVENTOR(S) : George S. Reppas et al It is certified that error appears in the above-indentified patent and that said Letters Patent is hereby corrected as shown below:

On the Title Page, under U.S. Patent Documents, "2,260,587" should be -- 2,260,687 --.

Column 1, line 23, "athletes" should be -- athlete's --.

Column 2, line 47, "flail" should be -- full --.

Column 4, lines 61 and 62, delete claim 10 in its entirety.

Column 4, line 63, "11." should be "10.".

Column 4, line 65, "12." should be "11.".

Column 5, line 1, "13." should be "12.".

Signed and Sealed this

Seventeenth Day of February, 1998

*Attest:*

*Attesting Officer*

Bruce Lehman

BRUCE LEHMAN

*Commissioner of Patents and Trademarks*